United States Patent [19]

Pavlacka

[11] Patent Number: 4,734,058

[45] Date of Patent: Mar. 29, 1988

[54] HIGH DENSITY SHIELDED MODULAR CONNECTOR FOR STACKING PRINTED CIRCUIT BOARDS AND METHOD OF MAKING THEREOF

[75] Inventor: Myron Pavlacka, Frankfort, Ill.

[73] Assignee: Amphenol Corporation, Wallingford, Conn.

[21] Appl. No.: 849,633

[22] Filed: May 8, 1986

[51] Int. Cl.[4] ..... H01R 13/658

[52] U.S. Cl. ..... 439/607

[58] Field of Search ..... 339/17 M, 17 LM, 14 R, 339/143 R; 439/607

[56] References Cited

U.S. PATENT DOCUMENTS 4,611,867 9/1986 Ichimura et al. ..... 339/143 R X 4,652,977 3/1987 Jones ..... 339/17 M X

*Primary Examiner*—Timothy V. Eley

*Attorney, Agent, or Firm*—Bacon & Thomas

[57] ABSTRACT

The invention relates to a modular connector assembly which is used in stacking plural printed circuit boards in a vertical configuration. The connector housing is made up of a plurality of corrugated sheets which have been assembled side by side and spot welded together to define a honeycomb array of passages. Dielectric surrounded contacts making up contact inserts are inserted into the respective passages to provide the connector. The invention also relates to a method assembling such a connector housing.

7 Claims, 16 Drawing Figures

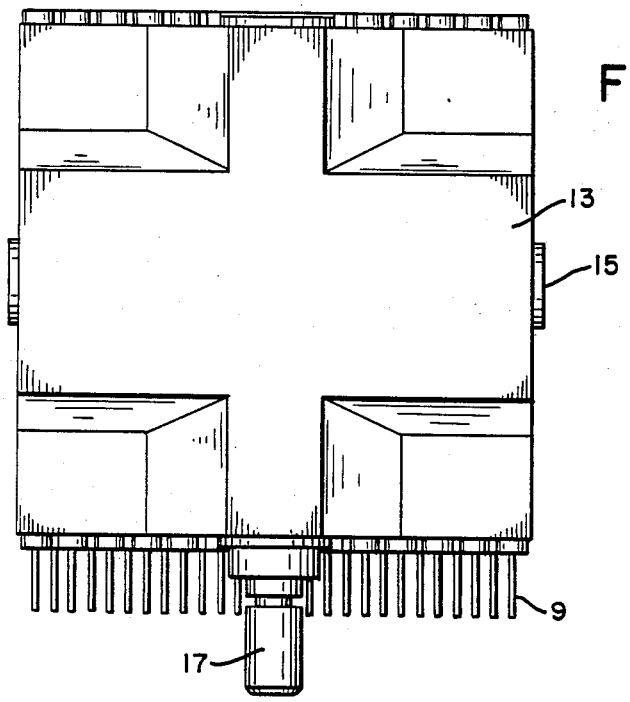
FIG. 6
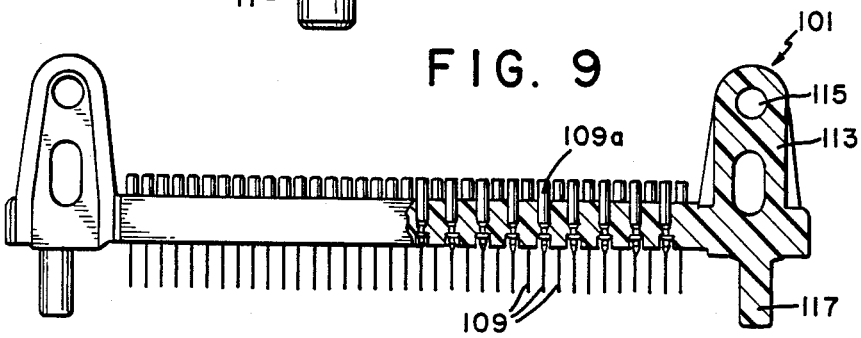
FIG. 9
FIG. 10
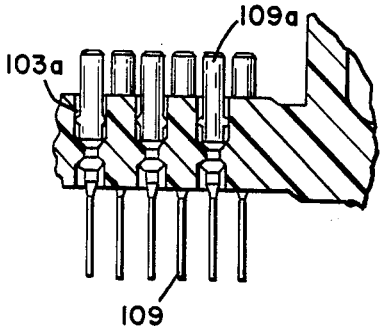
FIG. 11
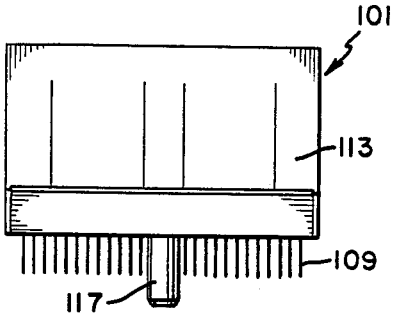

HIGH DENSITY SHIELDED MODULAR CONNECTOR FOR STACKING PRINTED CIRCUIT BOARDS AND METHOD OF MAKING THEREOF

BACKGROUND OF THE INVENTION

Field of the Invention

This invention relates to a high density connector system for use in interconnecting a plurality of printed circuit boards, which connections have to be shielded from outside electromagnetic interference, i.e., EMI. Furthermore, the invention relates to such a connector system which is modular and easily assemblable, and provides for high density with respect to the number of interconnections possible, as well as permitting such interconnections to be achieved with a negatively low insertion force when assembling the units in conjunction with printed circuit boards. The invention also relates to a method of making such an interconnect connector system.

In the past, when interconnecting a plurality of printed circuit boards together, there has typically been employed what is known as a right angle connector. In such a system, the main printed circuit board, i.e., typically known as a mother board, will include a number of connectors mounted thereon through which a plurality of other printed circuit boards, i.e., daughter boards can be mounted at a 90° orientation with respect to the mother board. While being satisfactory for most uses, such a system is limited in that only a limited number of daughter boards can be mounted on a single mother board. Furthermore, such an arrangement is also difficult to shield when it is desirable to avoid the effects of electromagnetic interference, i.e., EMI.

In supercomputer applications, a very large number of printed circuit boards are necessary for use in an interconnected manner and it is desirable to provide such an interconnect system which does not limit the number of printed circuit boards, i.e., PCBs, which can be interconnected and further, which is easily shieldable against the adverse effects of EMI.

In a preferred aspect, such a system would involve vertical stacking of the printed circuit boards with the interconnects or connectors mounted in-between in a "sandwich style" arrangement. Although desirable, in the past, such connectors have been relatively difficult and expensive to construct and shield. Thus, even though they have provided the greatest flexibility, generally the approach has been to employ a right angle type connector system because of the relative savings in cost.

SUMMARY OF THE INVENTION

In accordance with the invention, there is provided an EMI shielded interconnect system for electrically connecting vertically stacked printed circuit boards which obviates the above-discussed disadvantages as well as others which will become readily apparent from the following reading of the discussion of the invention.

In accordance with the invention, an EMI shielded interconnect system is provided for electrically connecting vertically stacked printed circuit boards. The interconnect system comprises a housing having a plurality of passages extending vertically therethrough in a honeycomb like matrix arrangement. The housing is made up of a plurality of stamped corrugated sheets of shielding material which have been bonded to each other in an interfit manner to define a plurality of passages vertically therethrough.

In a preferred aspect, each passage in the housing has a respective contact insert engageably received therein. Typically, the stamped corrugated sheets are made of stainless steel and have been spot and/or seam welded to make up the housing. The stamping of the corrugated sheets is such that when assembled together to form the housing, there is projection at a predetermined location inwardly into each of the passages to define contact engaging means for retaining each contact within their respective passages. Still further, preferably the contacts are insert assemblies wherein a centrally arranged conductive contact is surrounded by a dielectric material extending substantially along the entire length thereof for electrically insulating each contact from the walls of the passages. Optionally, a plurality of conductive elastomeric sleeves can be inserted in each passage surrounding each contact insert configured such that they extend a sufficient length from top to bottom of the housing so that when the interconnect system is employed to connect two printed circuit boards together, each of the conductive elastomeric sleeves abuts against the respective printed circuit boards to provide a substantially complete EMI shielded interconnection between the boards.

In another aspect, the invention relates to a method of manufacturing an EMI shielded interconnect system of the type discussd above. The method comprises the steps of stamping a plurality of stainless steel sheets into a corrugated configuration. Thereafter, each corrugated sheet is positioned adjacent respective ones of the sheets in a manner such that they are reciprocally offset with respect to each other. After such positioning, the sheets are spot welded to each other to make up the housing having a plurality of vertically extending passages defined by the corragations. As a further step, the method further involves inserting contact insert assemblies described above into respective ones of the passages.

BRIEF DESCRIPTION OF THE DRAWINGS

Having briefly discussed the invention, the same will become better understood from the following detailed discussion of the invention taken in conjunction with the attached drawings, wherein:

FIG. 6 is an end view of the connector in accordance with the invention taken along arrow BB of FIG. 5;

FIG. 9 is a partial side cross-sectional view taken along the same lines as FIG. 5 showing a terminating cap arrangement for use, for example, on the left-hand side of the stacking arrangement of FIG. 8;

FIG. 10 is an enlarged partial cross-sectional view of a section of the cap illustrated in FIG. 9; and FIG. 11 is an end view similar to that of FIG. 6, of the cap of FIG. 9.

DETAILED DISCUSSION OF THE INVENTION

Figure 1:
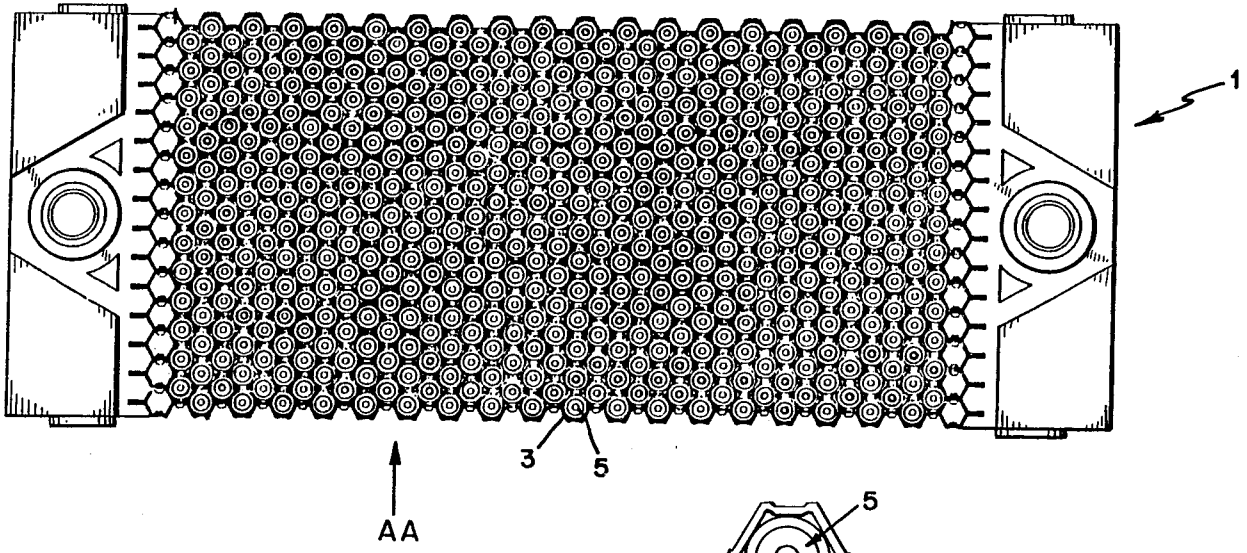
FIG. 1 is a top plan view of a connector in accordance with the invention, shown with contact insert assemblies inserted into respective passages thereof.

In FIG. 1 is shown a top plan view of a connector 1 in accordance with the invention. As shown therein, the connector is made up of a honeycomb matrix type arrangement of connector passages 3 wherein are vertically inserted contact insert assemblies 5. Preferably, the portion of the connector 1 containing the passages 3 is made of a material which is capable of shielding against electromagnetic interference, i.e., hereinafter EMI. Typically, such a material can be stainless steel. Other shielding materials as well known to those of ordinary skill in the art can be substituted.

Figure 2:
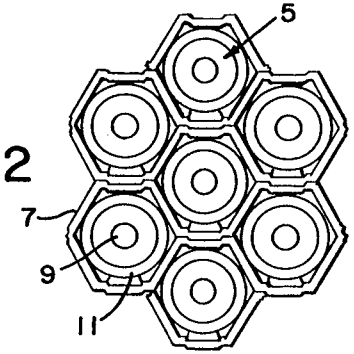
FIG. 2 is an enlarged view of a section of the connector in accordance with the invention, shown with the insert contact assemblies therein, taken along the same line as FIG. 1.
Figure 5:
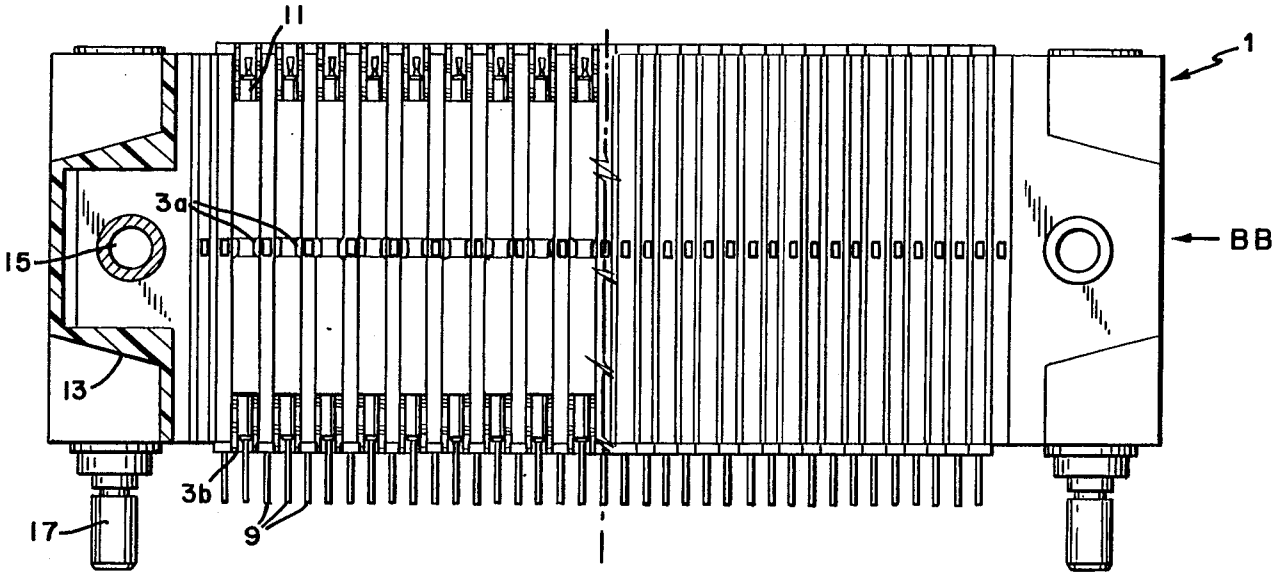
FIG. 5 is a side view in partial cross-section taken along arrow AA of FIG. 1 of the connector in accordance with the invention.

As further shown in FIG. 2, which shows an enlarged view of a portion of the connector of FIG. 1 shown in top plan view, the connector housing is made up of a plurality of passages 3 which are formed by taking individual sheets of metal, corrugating them, and then spot and/or seam welding them to each other in an offset arrangement as shown in FIG. 2. In FIG. 2, the individual sheets 7 which are corrugated are welded to each other to define the housing assembly. The contact assemblies 5 are typically made up of a central vertically extending contact 9 surrounded by a dielectric material 11. As further shown in FIG. 2, 3 and 5, the individual metal sheets 7 are corrugated in a manner such that, when viewed in the side cross-section view of FIG. 5, is stamped to include an inward projection 3*a* into each passage 3 to provide engaging means for holding the insert assemblies 5 within each passage 3. To this end, the method of manufacturing the insert assemblies lends itself easily to automation.

Figure 3:
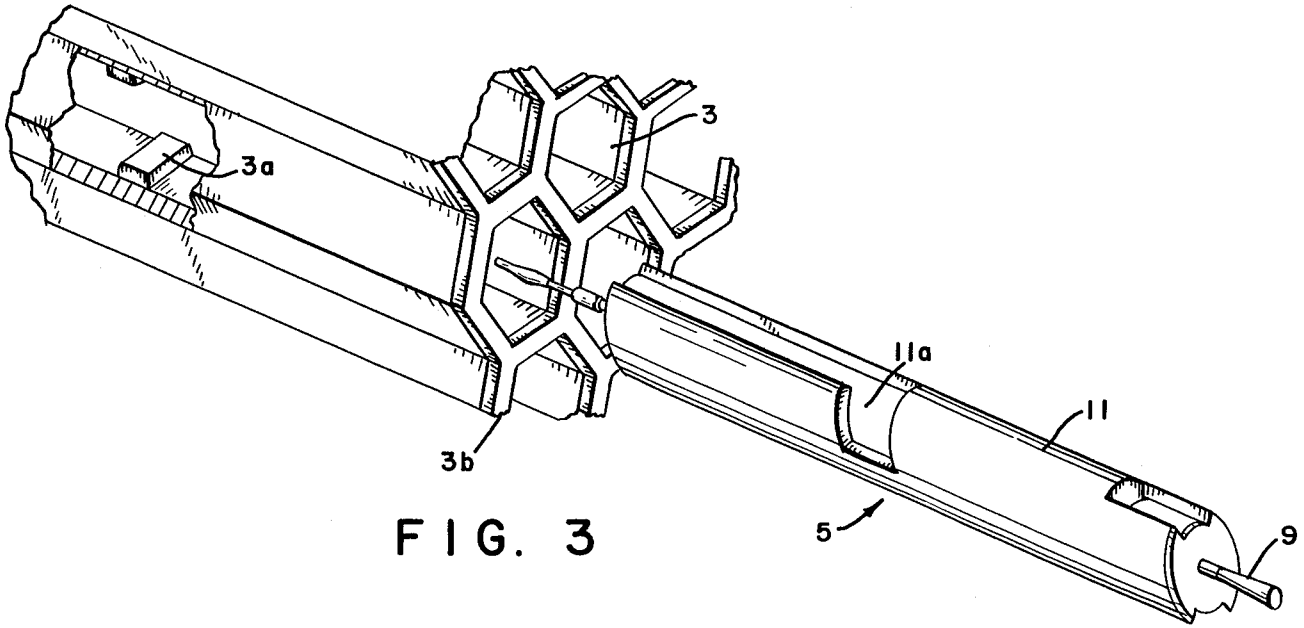
FIG. 3 is a perspective partial enlarged view, in partial cross-section, of a section of the connector in one embodiment of the invention, shown with a contact assembly being inserted therein.
Figure 4A:
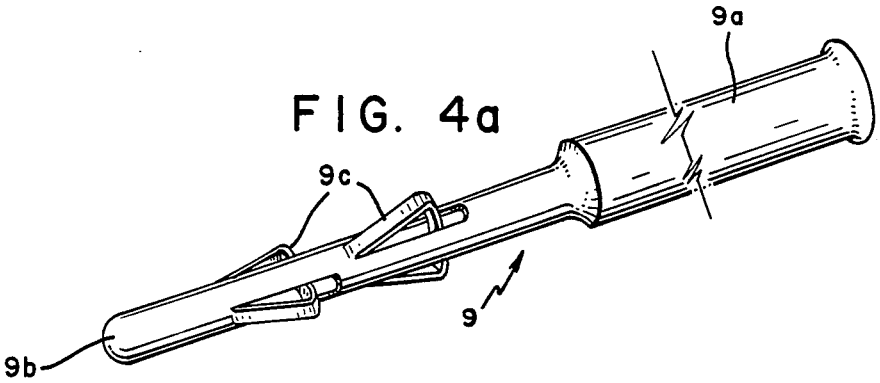
FIGS. 4*a*–4*f* respectively show a perspective view, an end view from the male end in a female end mounting passage, a partial side view of the male end in a female end mounting passage, a partial side view, and end view, and a cross-sectional side view of a preferred contact construction for use in accordance with the invention.
Figure 4B:
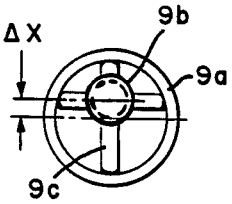
Figure 4C:
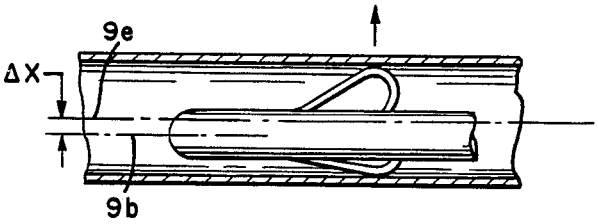
Figure 4D:
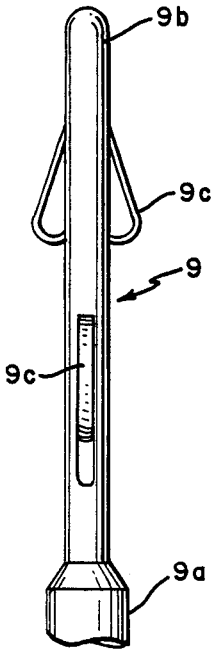
Figure 4E:
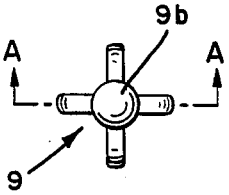
Figure 4F:
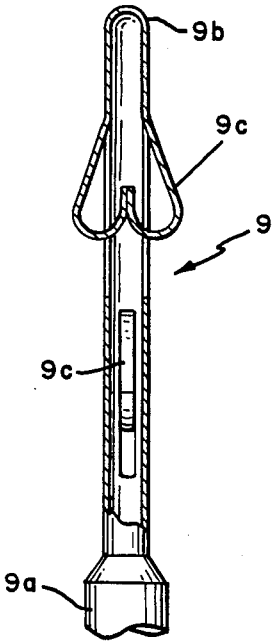

FIG. 4*a* shows in perspective view a preferred embodiment for the contact 9 in acordance with the invention without the dielectric sheath 11. The contact of FIG. 4*a* includes a male portion 9*b* which includes spring alignment portion 9*c* to compensate for any misalignment in establishing electrical connection between respective contacts. The structure of the spring portions 9*c* is more clearly seen in side view in FIG. 4*d*, end view of FIG. 4*e* and the cross-sectional view of FIG. 4*f* taken along line AA of FIG. 4*e*. In mating such contacts together, as shown in FIGS. 4*b* and 4*c*, even if the respective axes 9*e* and 9*d* thereof are not in alignment and displaced from each other by an amount $\Delta X$, the spring portions maintain connection between the male portion 9*b* and the inner walls of the female portion 9*a*. Dielectric material 11, as shown in FIG. 3 is employed substantially around the female barrel portion 9*a*.

As more clearly shown in FIG. 3, wherein the contact 9 is shown for illustrative purposes only without reference to specific features thereof, there will be provided an engaginng slot 11*a* on the dielectric portion 11 which is of an L-shaped configuration such that it will permit passage through the first portion of the L-configuration in sliding engagement with the abutment 3*a*. Thereafter, the contact insert assembly 5 is merely rotated to lock into the other portion of the L of the L-shaped slot 11*a*. In one embodiment of the invention, as shown in FIG. 3, which is not made of metal sheets and instead is manufactured as a one-piece molded conductive housing, at each end of the molded conductive housing there will be molded a conductive elastomeric gasket 3*b* to provide complete shielding in abutment with printed circuit boards to which is connected the housing 1. This is not a preferred construction and instead the preferred construction is described and shown with reference to the other figures.

FIG. 5 shows a side view, in partial cross-section, of the connector housing 1 in accordance with the invention taken along arrow AA of FIG. 1. As shown therein, the contact insert assemblies 5 are received within passages 3 of the connector housing 1. They are in abutment at their respective engaging L-shaped slot 11*a* of the dielectric 11 with engaging abutments 3*a*. In this construction, an alternative form of the conductive elastomeric gasket 3*b* shown in FIG. 3, for use in the preferred consturction, takes the form of a sleeve 3*b* received within each passages 3*a*. The sleeves 3*b* project from the housing 1 at each end a distance sufficient to come into abutment with the printed circuit board with which the connector 1 is employed to provide complete shielding. As shown further in FIG. 5 the male portions of the contacts 9 extend downwardly a predetermined distance beyond the housing 1.

At each end of the housing 1 are projections which include an overmolded conductive resin mounting portion which has a passageway 15 extending therethrough for ease of mounting and assembling a plurality of these housings 1 together in a rigid configuration. At the bottom of the housing are steps of leg-like projections 17 which mount in respective receiving openings 18 of a like housing 1, as shown in FIG. 8 of other housings 1, which mounting will be discussed hereinafter.

FIG. 6 shows an end view taken along arrow BB of the housing in accordance with the invention. The overmolded conductive resin portion 13 is more clearly shown as well as the rod mounting passage 15 and downward leg-like projection 17 which projects a distance greater than the male portion of the contacts 9.

Figure 7:
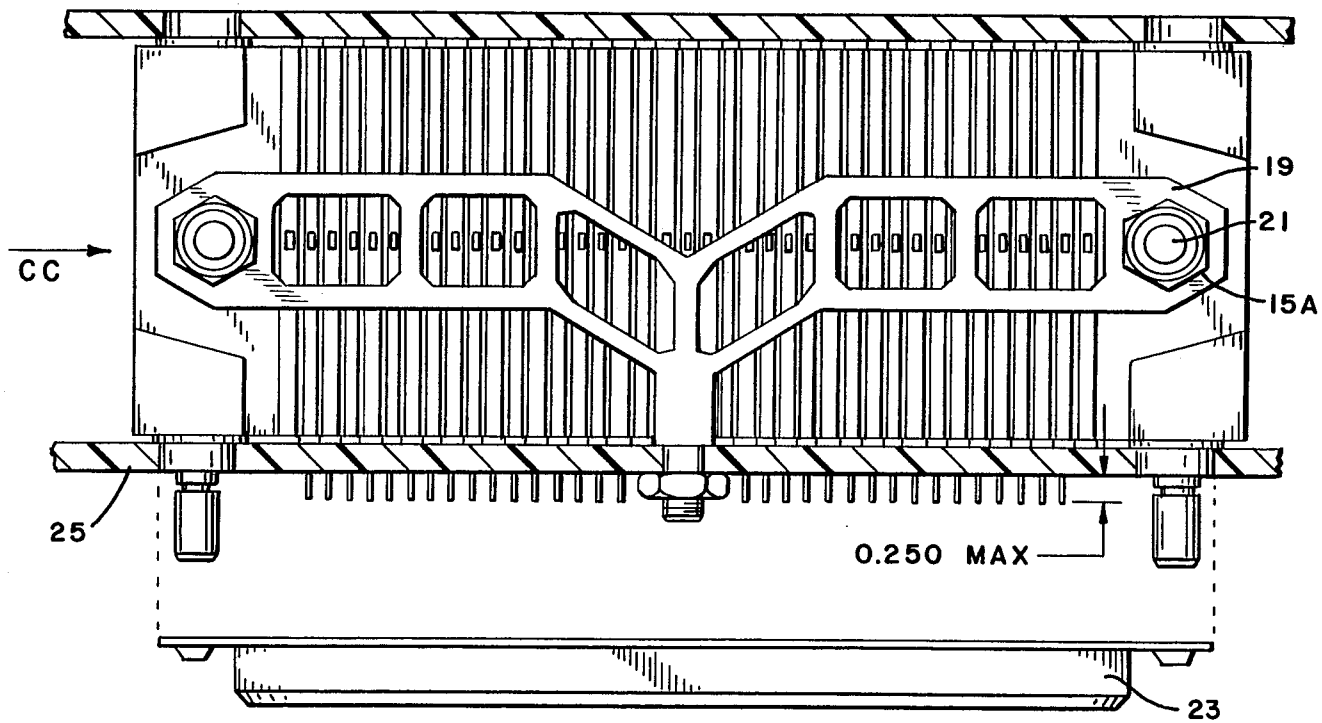
FIG. 7 is a side view of the connector assembly in accordance with the invention, shown assembled with mounting brackets, and with a protective shielding plate in position for being attached thereto.

FIG. 7 shows a side view as in FIG. 5 of the connector assembly 1 shown in a mounted printed circuit board arrangement with a bracket 19 which is held, and simultaneously serves to hold other connector assemblies together, by means of a rod 21 passing through all the connector assemblies, and a nut 15A. A shield plate 23 is provided shown about to be mounted to the assembly, which shield plate 23 serves the dual function of protecting the male ends of the contacts and at the same time provides a shielding effect against EMI when made of the appropriate material. As noted, the connector is mounted to printed circuit boards 25 with the male contact portions of the contacts 9 projecting only a predetermined distance as illustrated in FIG. 7.

Figure 8:
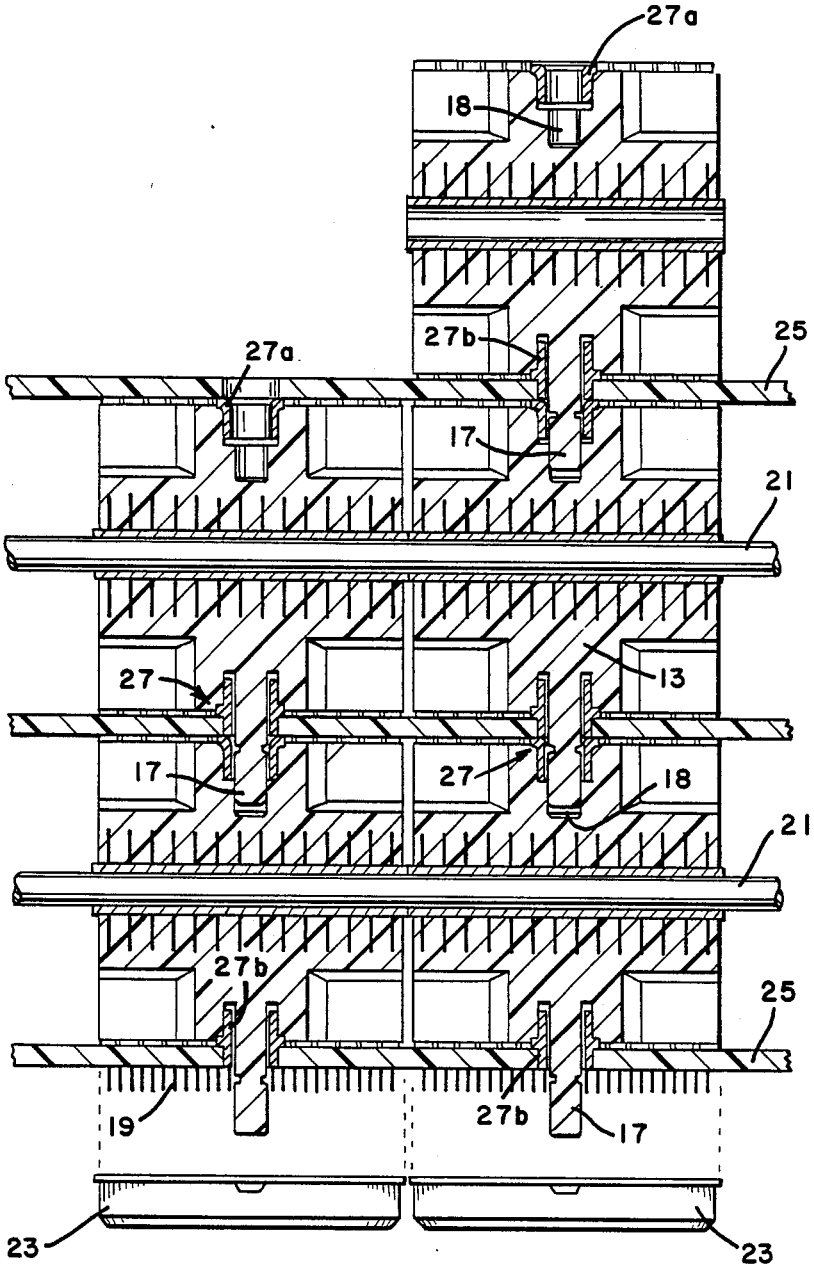
FIG. 8 is a cross-sectional view taken along arrow CC of FIG. 7 showing a plurality of connector assemblies in accordance with the invention shown mounted connected to a plurality of printed circuit boards and with the respective shielding and protecting plates about to be mounted thereon.

FIG. 8 shows a cross-sectional view of an assembled array of connectors 1 taken in cross-sectional view from the same side, i.e. arrow CC of FIG. 7, as in FIG. 6. As shown therein, the assembly can include a plurality of connectors which are held together by means of rods 21. Ground bushings 27 of a conventional material are provided to ground the connector assemblies to the printed circuit boards 25 and the vertical connector counterparts, i.e., connector to connector. Typically, the ground bushings 27 are a two-part 27*a* and 27*b* bushing as shown in the drawing. The shield plates 23 are also illustrated.

As can be seen on the left side of FIG. 8, it is often desirable to have the array of connectors 1 of differing height and extending through certain portions of printed circuit boards while not continuing on other portions. To this end, a terminating cap assembly 101 is shown in FIG. 9. This terminating cap assembly 101 will include, for example, corresponding mounting projections 117 which will fit into the appropriate receiving openings 18 of a connector 1. In addition, a passageway 115 is provided at an end 113 for rod 21. The cap assembly 101 includes contacts 109 which extend downwardly and are of a male configuration and include a cap 109*a*. As shown in FIG. 10, the contacts 109 are received within passages 103*a*. FIG. 11 shows an end view from the same direction as FIGS. 8 and 6, in this case of the terminating cap 101.

With respect to the cap 109*a* of the contacts 109, this is preferably made of polyphenylene sulfide plastic or another insulative material. Likewise, the cap 101 is also made of the same or a similar material, the only requirement being that it must be capable of withstanding reflow soldering temperatures. The selection of materials is conventional and will be readily apparent to those of ordinary skill in the art.

What is claimed is:

1. An EMI shielded interconnect for electrically connecting vertically stacked printed circuit boards, said interconnect comprising a housing having a plurality of passages extending vertically therethrough in a matrix arrangement, said housing being made up of a plurality of stamped corrugated sheets of shielding material which have been bonded to each other in an interfit manner, and each passage in said housing having a respective contact engageably received therein.

2. An EMI shielded interconnect as in claim 1 wherein said stamped corrugated sheets are made of stainless steel, and wherein said sheets have been at least seam welded to make up said housing.

3. An EMI shielded interconnect as in claim 2 wherein said corrugated sheets are stamped in a manner such that when assembled together to form said housing there is a projection at a predetermined location inwardly into each of said passages to define contact engaging means for retaining each contact within their respective passages.

4. An EMI shielded interconnect as in claim 2 wherein each of said contacts is arrayed as part of a contact insert assembly wherein the contact is embedded in a dielectric material extending substantially along the entire length thereof for electrically insulating each contact from the walls of said passages.

5. An EMI shielded interconnect as in claim 4 further comprising a plurality of conductive elastomeric sleeves inserted respectively in each passage surrounding each contact insert, and extending a sufficient length from top to bottom of said housing such that when said interconnect is employed to connect two printed circuit boards together, each of said conductive elastomeric sleeves abuts against the respective printed circuit boards to provide a substantially completely shielded interconnection between the boards.

6. An EMI shielded interconnect as in claim 1 wherein each of said contacts is arrayed as part of a contact insert assembly wherein the contact is embedded in a dielectric material extending substantially along the entire length thereof for electrically insulating each contact from the walls of said passages.

7. An EMI shielded interconnect as in claim 1 wherein said stamped corrugated sheets are made of stainless steel, and wherein said sheets have been at least spot welded to make up said housing.

* * * * *